US010107597B2

(12) United States Patent
Hawkins

(10) Patent No.: US 10,107,597 B2
(45) Date of Patent: Oct. 23, 2018

(54) MULTI-POSITION ACCESSORY MOUNT

(71) Applicant: Wayne Jerome Hawkins, Villa Rica, GA (US)

(72) Inventor: Wayne Jerome Hawkins, Villa Rica, GA (US)

( * ) Notice: Subject to any disclaimer, the term of this patent is extended or adjusted under 35 U.S.C. 154(b) by 0 days.

(21) Appl. No.: 15/211,109

(22) Filed: Aug. 26, 2016

(65) Prior Publication Data

US 2018/0058817 A1 Mar. 1, 2018

(51) Int. Cl.
*F41G 11/00* (2006.01)

(52) U.S. Cl.
CPC ..... *F41G 11/008* (2013.01); *F41G 11/003* (2013.01)

(58) Field of Classification Search
CPC ..... F41G 11/008; F41G 11/003
USPC ..... 42/140
See application file for complete search history.

(56) References Cited

U.S. PATENT DOCUMENTS

| | | | | |
|---|---|---|---|---|
| 2,445,087 | A * | 7/1948 | Rogers | F41G 11/008 42/128 |
| 7,676,975 | B2 * | 3/2010 | Phillips | F41C 23/14 42/72 |
| 9,032,659 | B1 * | 5/2015 | Duneman | F41C 27/00 42/71.01 |
| 2009/0044439 | A1 * | 2/2009 | Phillips | F41C 23/14 42/72 |
| 2015/0101232 | A1 * | 4/2015 | Schoenlau | F41G 11/003 42/90 |

* cited by examiner

*Primary Examiner* — Joshua E Freeman
(74) *Attorney, Agent, or Firm* — R. Tracy Crump

(57) ABSTRACT

The multi-position sight mount secures two or more weapon sights to a firearm and allows each sight to be selectively rotated between a vertical "aiming" position and an offset "auxiliary" position. The sight mount is mounted atop a conventional firearms and oriented to selectively position each optical sights in line with the longitudinal axis of the firearm barrel. The sight mounting includes a rotating cylinder mounted between a pair of mounting brackets attached to the firearm. The cylinder can be manually rotated between discreet positions to selectively move each sight between a 12 o'clock "aiming" position atop the firearm and a radially offset 3 or 9 o'clock "auxiliary" position.

5 Claims, 6 Drawing Sheets

MULTI-POSITION ACCESSORY MOUNT

This invention relates to sight mounts for firearms, and in particular a sight mount that allows multiple optical sights to be affixed atop a firearm and allows each optic sight to be selectively rotated between an "aiming" position and an offset "auxiliary" position.

BACKGROUND OF THE INVENTION

Firearms allow the use of a wide variety of optical devices, such as rifle scopes, telescopic sights, aperture sights, red dot sights and holographic sights in order to accurately place the projectile at the intended location. In order to accomplish this, the optical device should be mounted on top of the firearm with the centerline matching that of the projectile travel path centerline. The optical device must be adjusted based on each independent user position and line of sight as they aim through the device.

Different situations require the use of different types and configurations of optical devices. Optical devices that are intended to allow the user to accurately engage targets at a distance do not allow for the ability to accurately engage targets at close range. In order to accomplish this, many users install a second optical device at a 45° offsets to the firearm centerline or stack one optical configuration on top of another one. This adversely affects the accuracy and ease of use of the firearm.

There is a need for an optical device mount that can be adapted to any firearm that allows the user to install two independent optical devices on the firearm simultaneously. The mount must allow for quick transition between the two and ensure the desired optical device is positioned in the proper centerline as to maintain the user's accuracy and sight picture. It must have versatility of design to enable users to install a variety of different optical devices.

BRIEF SUMMARY OF THE INVENTION

The multi-position sight mount of this invention secures two or more weapon sights to a firearm and allows each sight to be selectively rotated between a vertical "aiming" position and an offset "auxiliary" position. The sight mount is mounted atop a conventional firearm and oriented to selectively position each optical sight in line with the longitudinal axis of the firearm barrel. The sight mounting includes a rotating cylinder mounted between a pair of mounting brackets attached to the firearm. The cylinder can be manually rotated between discreet positions to selectively move each sight between a 12 o'clock "aiming" position atop the firearm and a radially offset 3 or 9 o'clock "auxiliary" position. In the "aiming" position, the optical sight is centered and aligned atop the firearm allowing it to be used to aim the firearm in a conventional manner. In the auxiliary position, the optical sights rotate out of the user's field of view, but remain ready and "zeroed" once rotated back to the "aiming" position. By simply rotating the cylinder to position the desired optical sight in the "aiming" or "auxiliary" positions, both optical sights remain readily available to the user.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
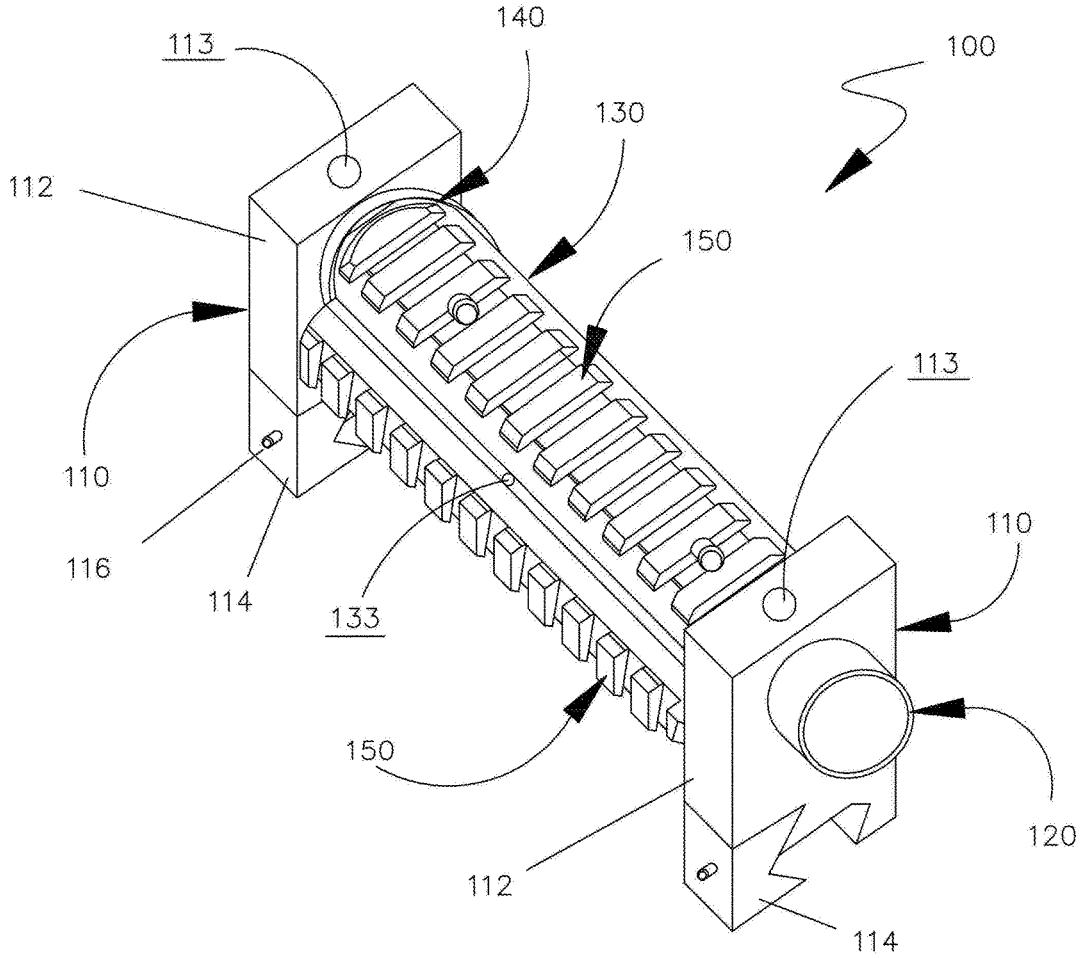
FIG. 1 is a perspective view of an exemplary embodiment of the accessory mount of this invention.
Figure 2:
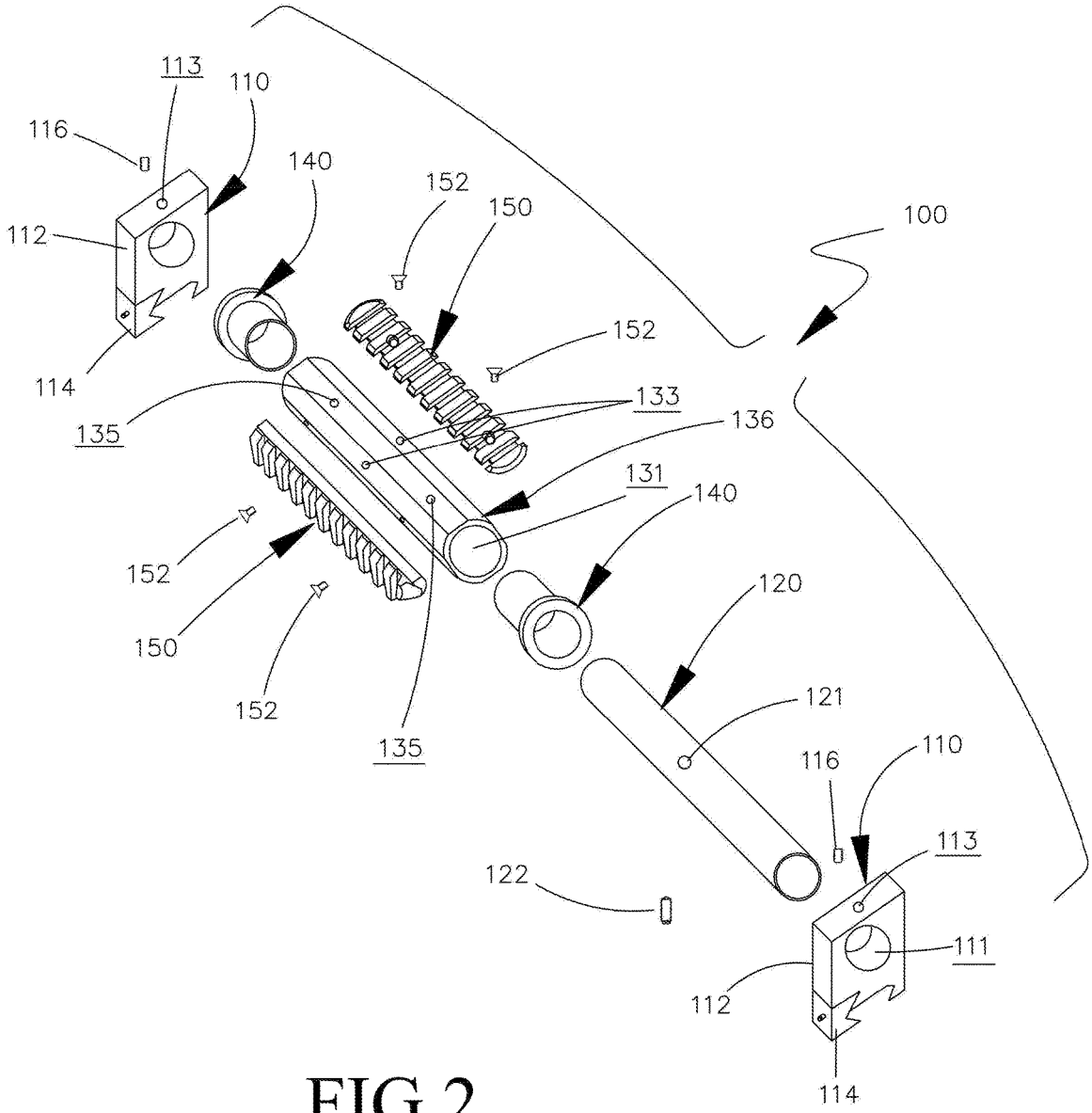
FIG. 2 is an exploded perspective view of the accessory mount of FIG. 1.
Figure 3:
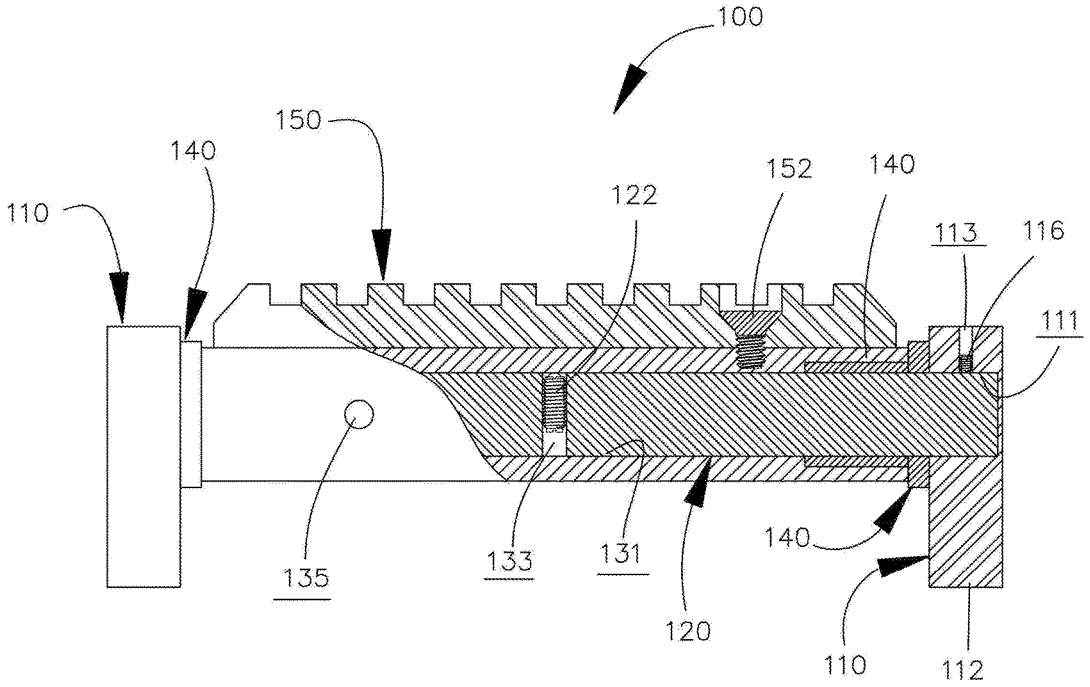
FIG. 3 is a partial side sectional view of the accessory mount of FIG. 1.
Figure 4:
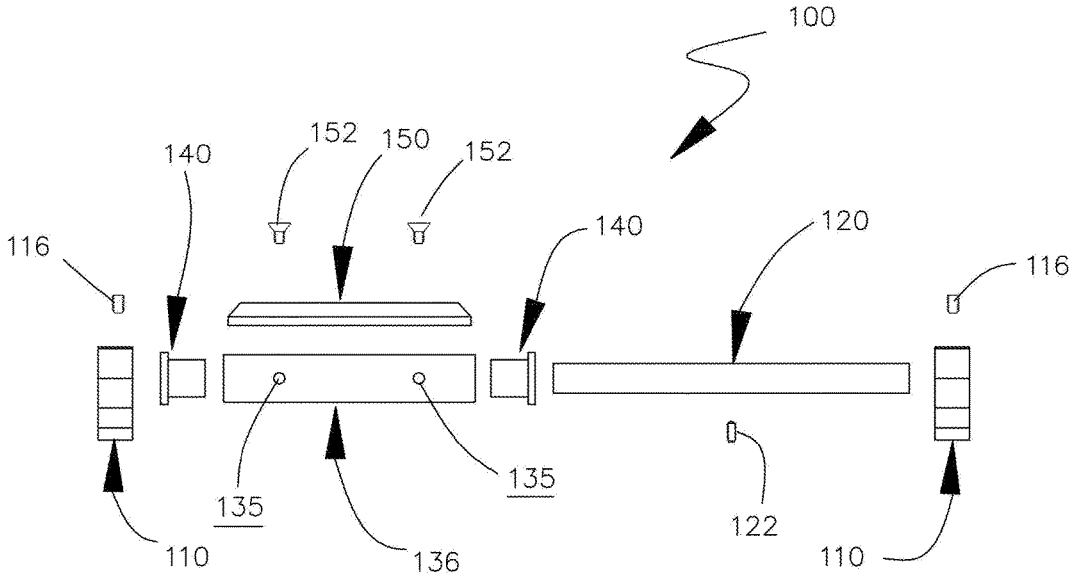
FIG. 4 is an exploded side view of the accessory mount of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-6 illustrate an exemplary embodiment of the multi-position sight apparatus (the "mount"), which is designated generally as reference numeral 100. Mount 100 secures two separate optical sights 10 and 20 atop a conventional firearm (not shown). Mount 100 allows each optical sight to be selectively rotated between a vertical "aiming" position and an offset "auxiliary" position. Mount 100 is mounted atop a conventional firearm and oriented to selectively position each optical sight in line with the longitudinal axis of the firearm barrel. Mount 100 is affixed directly to a firearm (not shown) in the same manner as conventional scope rings, which are well known in the art. Mount 100 can be adapted to mount to any conventional firearm, but is particularly adapted for use with rifles. In addition, the mount can be used with non-optical sights, such as back up iron sights, or other sighting accessories, such as range finders and lasers. Standard aperture sights can also be added in conjunction or incorporated into the optical mount to allow for three independent sight devices on the same firearm.

Mount 100 includes a pair of mounting structures or brackets 110, a shaft mounted between the brackets 110 within a pair of thrust bearings 140, a cylinder 130 rotatably mounted over the shaft, a plurality (two shown) of Picatinny rail panels 150 mounted to the sides of the cylinder. Each of the base components is formed, cast, machined or crafted from a suitable metal, polymer or composite material. The materials used for each component are selected for strength, durability and light weight. Mount 100 may be sized and dimensioned, as necessary to accommodate the particular firearm, optics and sighting accessories combinations.

Each mounting bracket 110 includes a bracket body 112 and a clamp member 114 secured to the bracket body by a threaded fastener (bolt) 116. Mounting brackets 110 secure mount 100 to firearm 10. Mounting bracket 110 is configured to affix to a Picatinny or dove tail style rail component atop firearm 10. In other embodiments, bracket body 112 and clamp member 114 may be configured, adapted or modified to securely affix to other conventional rail interface systems used by other firearms.

Shaft 120 extends between mounting brackets 110, which are affixed to the firearm, such that the longitudinal axis of the shaft is spaced above and parallel to the barrel axis of the firearm. The ends of shaft 120 are seated within central shaft openings 111. Shaft 120 has a hollow or tubular body, but may be solid in other embodiments. Shaft 120 is secured between mounting brackets 119 by fasteners (screws) 116, which turn into threaded bores 113 on top of the brackets to engage the shaft.

Cylinder 130 is concentrically mounted over shaft 120 to rotate about the shaft longitudinal axis between two discrete positions about the shaft. Cylinder 130 has a hollow tubular body with eight outer longitudinal flats on its sidewall. The ends of cylinder 130 are rotatably seated within thrust bearings 140 fitted over shaft 120. Cylinder 130 has a pair of depressions or holes ("locking holes") 133, which receive the retaining pin 122. As shown, locking holes 133 are offset radially approximately ninety degrees (90) from one another.

Picatinny rail panels 150 are mounted to cylinder 130 to provide the connection interface for optical sights 10 and 20. Picatinny style rails are a common rail interface system for firearm. In other embodiments of the invention, other rail interface systems may be incorporated to affix optical sights and other accessories to the rotating cylinder. Rail panels 150 are secured by fasteners (screws) 152, which extends through bores in the panels and turn into threaded bores 135 in cylinder 130. Rail panels 150 are affixed to extend longitudinally along the sides of cylinder 130 and are offset radially approximately ninety degrees (90°) from one another on the cylinder, which positions optic sights 20 to be aligned parallel to the longitudinal axis of shaft 120.

Cylinder 130 is locked into one of the two discrete positions about shaft 120 by a "positive positioning device" in the form of a spring tensioned plunger or retention pin 122. Retention pin 122 is disposed within a lateral bore 121 in shaft 120 and extends outward from the shaft under spring tension. Retention pin 122 is biased to extend from shaft 120 and seat within one of lock holes 133 of cylinder 130. Retention pin 122 can be manually depressed to unseat from lock holes 133, thereby allowing cylinder 130 to rotate about shaft 120 and selectively lock cylinder 120 in either of the two discrete positions.

Figure 5:
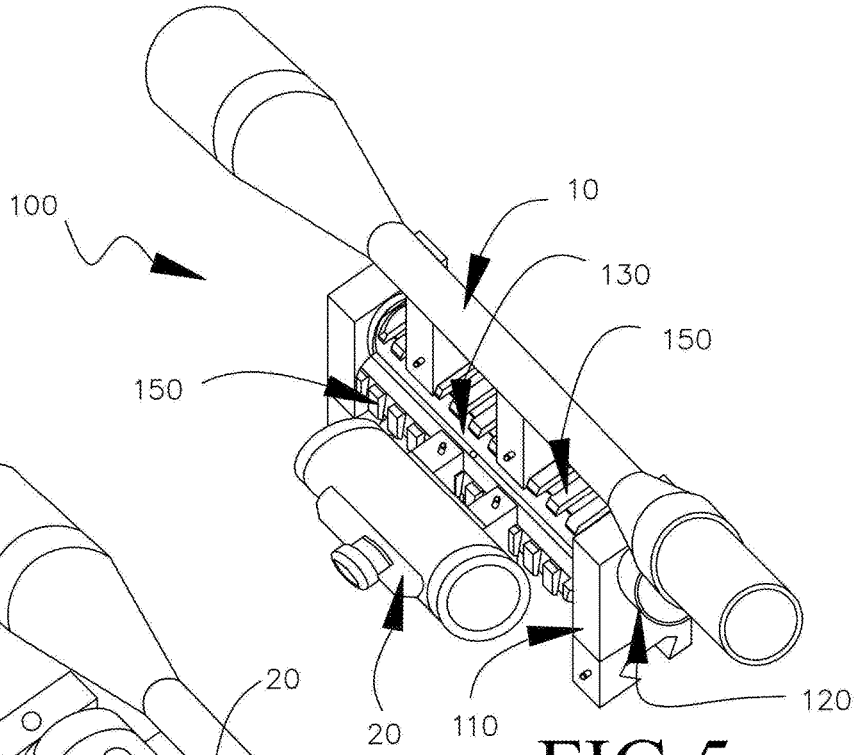
FIG. 5 is a perspective view of two optics mounted to the accessory mount of FIG. 1 showing one of the optics rotated into the "aiming" position for use on a weapon.
Figure 6:
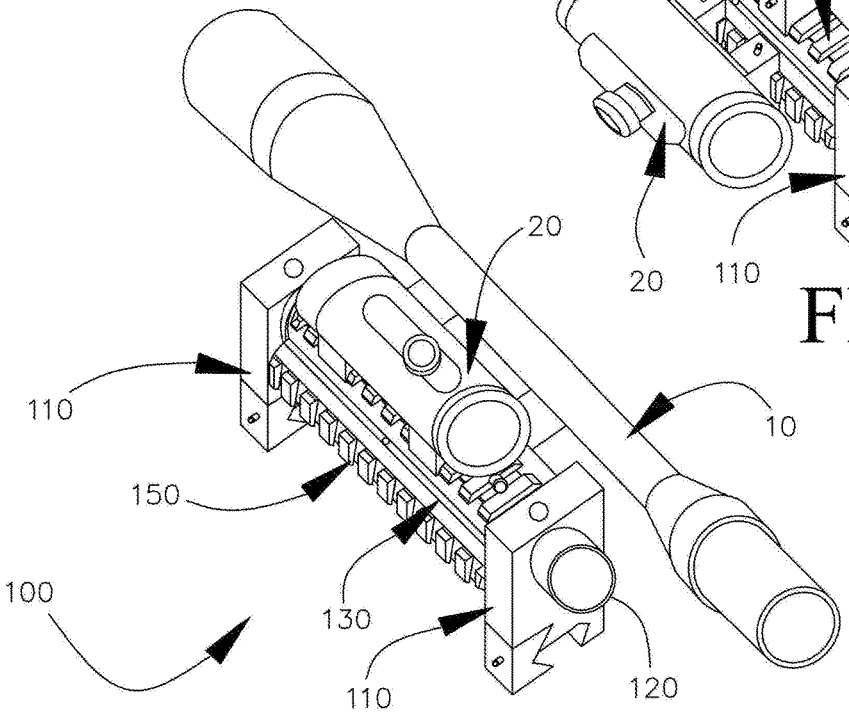
FIG. 6 is another perspective view of two optics mounted to the accessory mount of FIG. 1 showing the other of the optics rotated into the "aiming" positioned for use on a weapon.

As shown in FIGS. 5 and 6, optical sights 10 and 20 are attached to rail panels 150 on cylinder 130. Users rotate cylinder 130 to selectively move optical sights 10 and 20 between a 12 o'clock "aiming" position atop the firearm and an radially offset 3 or 9 o'clock "auxiliary" position. The user moves the optical sights between the operational and stowed positions by depressing pin 122 and rotating cylinder 130. Once cylinder 130 rotates to the next position, pin 122 extends into hole 133 to hold cylinder 130 in place.

When one optical device is rotated into the 12 o'clock or "aiming" position, the other optical device is offset at either the 3 or 9 o'clock or "auxiliary" position. In the 12 o'clock "aiming position, the optical devices' "line of sight" lies within a plane containing the barrel axis and the longitudinal axis of shaft 120 and cylinder 130. In the "auxiliary" position, the optical device's line of sight is offset from the plane containing the barrel axis and the longitudinal axis of shaft 120 and cylinder 130. In the "aiming" position, the optical sight is centered and aligned atop the firearm allowing it to be used to aim the firearm in a conventional manner. In the "aiming" position, the user "sight in" or "zero" the optical sight to the firearm. In the auxiliary position, the optical sights rotated out of the user's field of view, but remain "zeroed" when rotated back to the "aiming" position. By simply rotating cylinder 130 to position the desired optical sight in the "aiming" or "auxiliary" positions, both optical sights remain readily available to the user.

Embodiment 2

Figure 7:
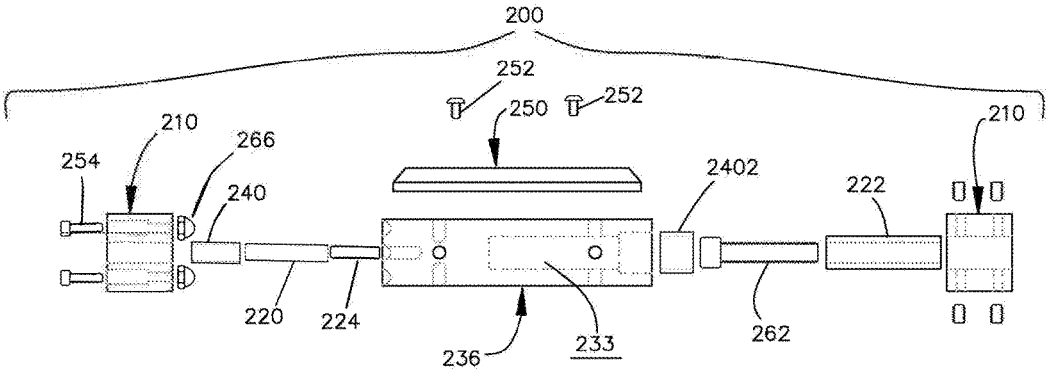
FIG. 7 is an exploded side view of a second exemplary embodiment of the accessory mount of this invention.
Figure 8:
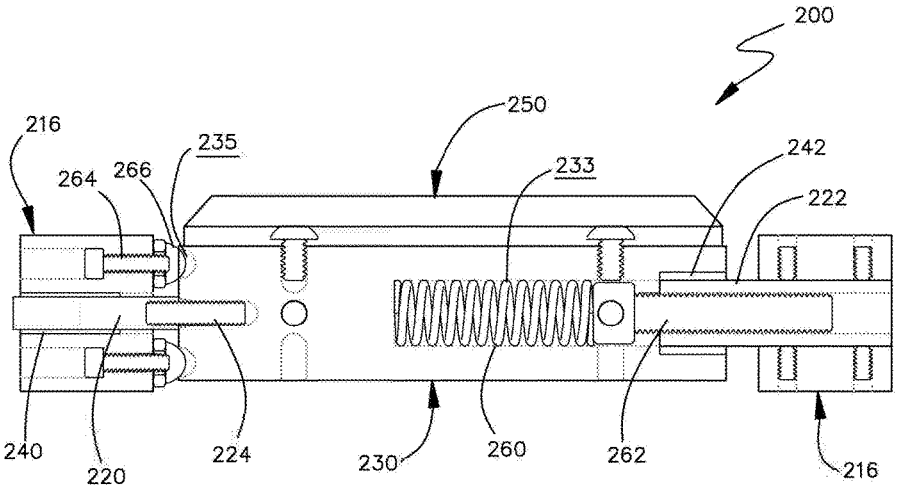
FIG. 8 is a side sectional view of the accessory mount of FIG. 7.

FIGS. 7-8 illustrate a second exemplary embodiment of the multi-position sight apparatus (the "mount"), designated generally as reference number 200. Mount 200 is similar in design and operation, as mount 100 above. Mount 200 differs only in how the cylinder is fitted between the mounting brackets and the locking mechanism, which secures the cylinder in its discrete positions.

As shown, mounting 200 includes a pair of mounting structures or brackets 210, a rotatable cylinder 230 mounted between the brackets 210. Cylinder 230 has a generally solid body. Cylinder 230 rotates about aligned end shafts—"exit" shaft 220 and "entry" shaft 222. Exit shaft 220 is affixed to cylinder 203 by a threaded coupling stud 224, which is turned into a threaded axial bore 231 in the end of cylinder 230. Exit shaft 220 extends longitudinally from cylinder 230 into a thrust bearings 240 seated within the "exit" mounting bracket 210. Entry shaft 224 is an internally threaded tube that is seated directly within the "entry" mounting bracket. Entry shaft 224 extends through a second thrust bearing 242 seated within an axial bore 233 in cylinder 230.

Cylinder 230 is locked into one of the two discrete position about shaft 120 by a "positive positioning device" in the form of a coil spring 260 disposed within cylinder 230 and a pair of position fasteners mounted to "exit" mounting bracket 210. Coil spring 260 is disposed within axial bore 233. Spring adjustment screw 262 is turned into entry shaft 224. Spring adjustment screw 262 extends into axial bore 233 and abuts coil spring 260. The engagement between spring adjustment screw 262 and coil spring 260 within axial bore 233 biases cylinder 230 longitudinally toward "exit" mounting bracket 210. Exit mounting bracket 210 includes a pair of positioning fasteners—screws 264 and nut 266. Each positioning nuts 266 seats within one of a plurality of radially spaced detents 235 formed in the "exit" end of cylinder 230 to hold cylinder 230 in one of its discrete position about the shafts. Manually pressing cylinder 230 towards "entry" mounting bracket 210, compresses coil spring 260 withdrawing position nuts 266 from detents 235 and allowing the cylinder 230 to rotate freely about shafts 220 and 222. Once rotated to the desired position, manual pressure is released allowing coil spring 260 to urge cylinder 230 toward "exit" mounting bracket 210 seating position nuts 266 into their aligned detents 235.

As with mount 100, Picatinny rail panels 250 are mounted to cylinder 230 to provide the connection interface for the optical sights. Rail panels 250 are secured by fasteners (screws) 252, which extend through bores in the panels and turn into threaded bores 235 in cylinder 230. Rail panels 250 are affixed to extend longitudinally along the sides of cylinder 230 and are offset radially approximately ninety degrees (90°) from one another on the cylinder, which positions the optic sights to be aligned parallel to the axis of rotation for cylinder 230.

The user moves the optical devices between the "aim" and "auxiliary" positions by manually sliding cylinder 230 against the tension of coil spring 260 to unseat position nuts 266 from detents 235 and rotating cylinder 230 to the desired position. Once cylinder 230 rotates to the desired position, cylinder 230 is manually released and coil spring 260 urges cylinder 230 back to seat position nuts 266 within detents 235, locking the cylinder in the desired position.

The multi-position sight apparatus (the "mount") of this invention provides several advantages over conventional scope mounts. The mount allows multiple sights or other optical devices and accessories to be fitted to a single firearm. In addition, each sight fitted to the firearm remains readily accessible to the user by the rotation of the cylinder. The user can quickly move sights between an "aiming" position and the "auxiliary" position, while maintaining each sight's "zero." In the "aiming" position, the optical sight is centered and aligned atop the firearm allowing it to be used to aim the firearm in a conventional manner. In the auxiliary position, the optical sights rotate out of the user's field of view, but remain ready and "zeroed" once rotated back to the "aiming" position. By simply rotating cylinder 130 to position the desired optical sight in the "aiming" or "auxiliary" positions, both optical sights remain readily available to the user. The mount has a variety of firearm applications, including military and law enforcement, competition and recreational shooting, hunting, and self defense. The mount of this invention is applicable in any applications that require switching between two devices while maintaining repeatable elevation and center lines.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

What is claimed is:

1. An apparatus for securing a first optic accessory and a second optic accessory to a firearm including an elongated barrel having a longitudinal barrel axis, the apparatus comprising:

a mounting bracket detachably connected to the firearm to extend from the firearm perpendicular to the barrel axis; and a rotating member fitted to the mounting bracket for rotational movement about a rotational axis spaced above and parallel to the barrel axis between a first position and a second position, the rotating member adapted to receive the first optic accessory affixed thereto at a first location on the rotating member and to receive the second optic accessory affixed thereto, such that the first optic accessory lies within a plane containing the barrel axis and the rotational axis of the rotating member when the rotating member is in the first position and the second optic accessory lies within the plane containing the barrel axis and the rotational axis of the rotating member when the rotating member is in the second position.

2. The apparatus of claim 1 and an elongated shaft extending from the mounting bracket spaced from and parallel to the barrel axis, the rotating member is an elongated tubular part fitted about the shaft.

3. The apparatus of claim 2 wherein the shaft has a lateral bore therein and a spring loaded plunger seated within the bore and extensible therefrom for restrictively engaging the rotating member when the rotating member is in one of the first position and the second position.

4. The apparatus of claim 1 and means for selectively locking the rotating member in one of the first position and second position.

5. The apparatus of claim 1 wherein the rotating member includes a first rail component affixed to the rotating member at the first location and a second rail component affixed to the rotating member at the second location.

* * * * *